US008214948B2

(12) United States Patent
Gatzke et al.

(10) Patent No.: US 8,214,948 B2
(45) Date of Patent: Jul. 10, 2012

(54) ADJUSTABLE BED SKIRT

(75) Inventors: Carolyn Jo Gatzke, Long Beach, CA (US); Diane Holnagel Lechner, Long Beach, CA (US)

(73) Assignee: Engage Environments LLC, Long Beach, CA (US)

( * ) Notice: Subject to any disclaimer, the term of this patent is extended or adjusted under 35 U.S.C. 154(b) by 0 days.

(21) Appl. No.: 13/119,701

(22) PCT Filed: Sep. 16, 2009

(86) PCT No.: PCT/US2009/057105

§ 371 (c)(1), (2), (4) Date: Mar. 17, 2011

(87) PCT Pub. No.: WO2010/033555

PCT Pub. Date: Mar. 25, 2010

(65) Prior Publication Data

US 2011/0167561 A1 Jul. 14, 2011

Related U.S. Application Data

(60) Provisional application No. 61/097,603, filed on Sep. 17, 2008.

(51) Int. Cl.
*A47G 9/02* (2006.01)

(52) U.S. Cl. ..... 5/493; 5/486

(58) Field of Classification Search ..... 5/482, 485, 5/486, 493, 498, 907; 108/50.11
See application file for complete search history.

(56) References Cited

U.S. PATENT DOCUMENTS 4,021,869 A * 5/1977 Root ..... 5/498

(Continued)

FOREIGN PATENT DOCUMENTS

KR 20-1997-0053352 10/1997

OTHER PUBLICATIONS

International Search Report from Korean Intellectual Property Office for corresponding PCT application No. PCT/US2009/057105 dated May 10, 2010.

(Continued)

*Primary Examiner* — Michael Trettel
(74) *Attorney, Agent, or Firm* — Klein, O'Neill & Singh, LLP

(57) ABSTRACT

An adjustable bed skirt includes a deck with a peripheral edge around its perimeter, and a ruffle attached around the perimeter of the deck at the peripheral edge. The deck includes a releasable longitudinal fold and a releasable lateral fold, reversibly secured by closure members. The ruffle includes a plurality of releasably extendible pleats. Each of the longitudinal and lateral folds extends into an associated one of the pleats. When the longitudinal fold is released, the deck and the ruffle are changed from a first, folded width to a second, unfolded width. When the lateral fold is released, the deck and the ruffle are changed from a first, folded length to a second, unfolded length.

16 Claims, 10 Drawing Sheets

U.S. PATENT DOCUMENTS

| | | | | |
|---|---|---|---|---|
| 4,304,018 | A * | 12/1981 | McClam | 5/494 |
| 4,316,299 | A | 2/1982 | Friedman | |
| 4,402,098 | A | 9/1983 | McClam | |
| 6,151,731 | A * | 11/2000 | Saparow | 5/493 |
| 6,925,667 | B2 * | 8/2005 | Cohen | 5/493 |
| 2004/0237197 | A1 | 12/2004 | Cohen | |
| 2007/0214569 | A1 | 9/2007 | Miller | |
| 2009/0044336 | A1 * | 2/2009 | Jackson | 5/486 |

OTHER PUBLICATIONS

Written Opinion from Korean Intellectual Property Office for corresponding PCT application No. PCT/US2009/057105 dated May 10, 2010.

International Preliminary Report on Patentability for corresponding PCT application No. PCT/US2009/057105 dated Mar. 22, 2011.

* cited by examiner

ADJUSTABLE BED SKIRT

CROSS-REFERENCE TO RELATED APPLICATION

This application is a national phase filing, under 35 U.S.C. §371(c), of International Application Serial Number PCT/US2009/057105, filed on Sep. 16, 2009, which claims priority from provisional application Ser. No. 61/097,603 filed on Sep. 17, 2008, the contents of both prior applications being expressly incorporated herein by reference in their entireties.

BACKGROUND

This disclosure relates generally to the field of bedding articles. In particular, this disclosure relates to bed skirts and the like, and more specifically to adjustable bed skirts.

Bed skirts and dust ruffles are common bedding accessories. They are utilitarian and decorative. Bed skirts (also referred to as dust skirts) assist in preventing dust and other foreign objects from settling beneath a bed. They also hide items that may be stored under a bed. They are designed to complement bedroom décor and other bed accessories including sheets, comforters, quilts and bedspreads.

A conventional bed skirt is made of cloth fabric (such as linen, cotton, or a cotton/polyester blend), and it comprises a flat, rectangular supporting sheet or "deck" configured to be positioned between an upper mattress and a lower mattress (or box spring) of a bed. A skirt portion or "ruffle" is sewn around the perimeter of the deck and extends downwardly from the peripheral edge of the deck over the lower mattress (or box spring) toward the floor. The rectangular deck is usually dimensioned to fit over a conventional lower mattress or box spring, such that the edges of the deck substantially coincide with the edges of the mattress, enabling the skirt portion to merely hang down from the sides of the deck. As described, the conventional bed skirt is designed to fit a single, standard sized mattress or bed. Thus, a crib bed skirt is usable only with a crib, a twin bed skirt is usable only with a twin bed, and a full bed skirt is usable only with a full bed.

Thus, there remains a need for an adjustable bed skirt that can be easily adaptable for use with any size of bed, including cribs, twin beds, full beds, and, optionally, queen and/or king beds.

SUMMARY

As described in the present disclosure, the aforementioned needs are met by providing an adjustable bed skirt that can be easily adaptable for use with any size of bed.

In accordance with an aspect of the present disclosure, an adjustable bed skirt comprises a deck having a peripheral edge, a releasably securable longitudinal fold, and a releasable securable lateral fold; a ruffle attached to the peripheral edge of the deck and including a plurality of extendible pleats extending from the peripheral edge of the deck to a free edge, wherein each of the longitudinal and lateral folds extends into an associated one of the pleats; whereby the deck and the ruffle are changed from a first, folded length to a second, unfolded length when the lateral fold is released; and whereby the deck and the ruffle are changed from a first, folded width to a second, unfolded width when the longitudinal fold is released.

In another aspect of the present disclosure, an adjustable bed skirt is provided comprising a deck having a peripheral edge. A releasably securable longitudinal fold and a releasable securable lateral fold are formed on or in the deck to form a first deck area for fitting over a first bed size. A ruffle extends from the peripheral edge of the deck and including a plurality of extendible pleats extending from the peripheral edge of the deck to a free edge. Wherein each of the longitudinal and lateral folds extends into an associated one of the pleats and wherein the deck has a second deck area, which is larger than the first deck area for fitting over a second bed size, when the releasably securable longitudinal fold and the releasably securable lateral fold are expanded.

In accordance with another aspect of the present disclosure, a method for making an adjustable bed skirt comprises: (a) providing a deck having a first length, a first width, and peripheral edge; (b) providing a ruffle comprising first and second peripheral edges; (c) attaching the ruffle around the perimeter of the deck at the peripheral edge of the deck; (d) folding the deck to create a longitudinal fold and a lateral fold; (e) releasably securing the longitudinal fold and the lateral fold to change the width of the deck to a second width less than the first width and a second length less than the first length; (f) forming a plurality of releasable pleats in the ruffle, the pleats being located so that each of the lateral folds and each of the longitudinal folds coincides with an opposed pair of the pleats; and (g) releasably securing the pleats that coincide with the lateral fold and the longitudinal fold.

In accordance with still another aspect of the present disclosure, a method is provided for using an adjustable bed skirt, wherein the bed skirt comprises a deck releasably folded into a lateral fold and a longitudinally fold so as to have a length and a width and a peripheral edge; and a ruffle attached around the perimeter of the deck at the peripheral edge of the deck, the ruffle having a plurality of releasably extendible pleats aligned with the lateral fold and the longitudinal fold, the method comprising: (a) releasing the pleats; (b) releasing the lateral fold and unfolding the deck along the lateral fold to increase the length of the deck; and (c) releasing the longitudinal fold and unfolding the deck along the longitudinal fold to increase the width of the deck.

Other aspects and variations of the assemblies summarized above are also contemplated and will be more fully understood when considered with respect to the following disclosure.

BRIEF DESCRIPTION OF THE DRAWINGS

These and other features and advantages of the present invention will become appreciated as the same become better understood with reference to the specification, claims and appended drawings wherein:

DETAILED DESCRIPTION

The detailed description set forth below in connection with the appended drawings is intended as a description of the presently preferred embodiments of the adjustable bed skirt provided in accordance with aspects of the present disclosure, and it is not intended to represent the only forms in which the adjustable bed skirt in accordance with this disclosure may be constructed or utilized. The description sets forth the features and the steps for constructing and using the adjustable bed skirt of the present disclosure in connection with the illustrated embodiments. It is to be understood, however, that the same or equivalent functions and structures may be accomplished by different embodiments that are also intended to be encompassed within the spirit and scope of the disclosure. As denoted elsewhere herein, like element numbers are intended to indicate like or similar elements or features.

Figure 1:
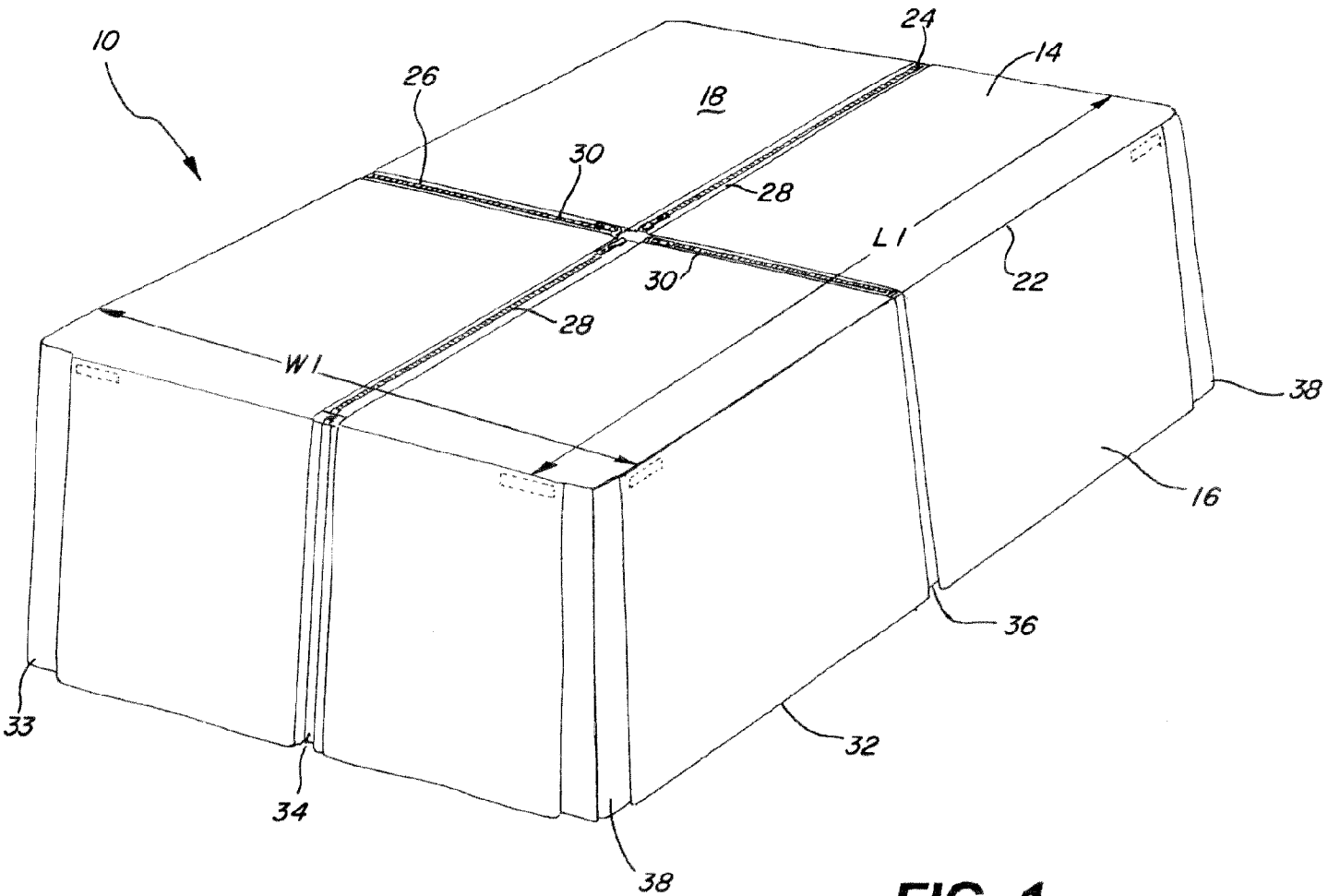
FIG. 1 is a top perspective view of an exemplary adjustable bed skirt configured for use with a crib in accordance with aspects of the present disclosure.
Figure 2:
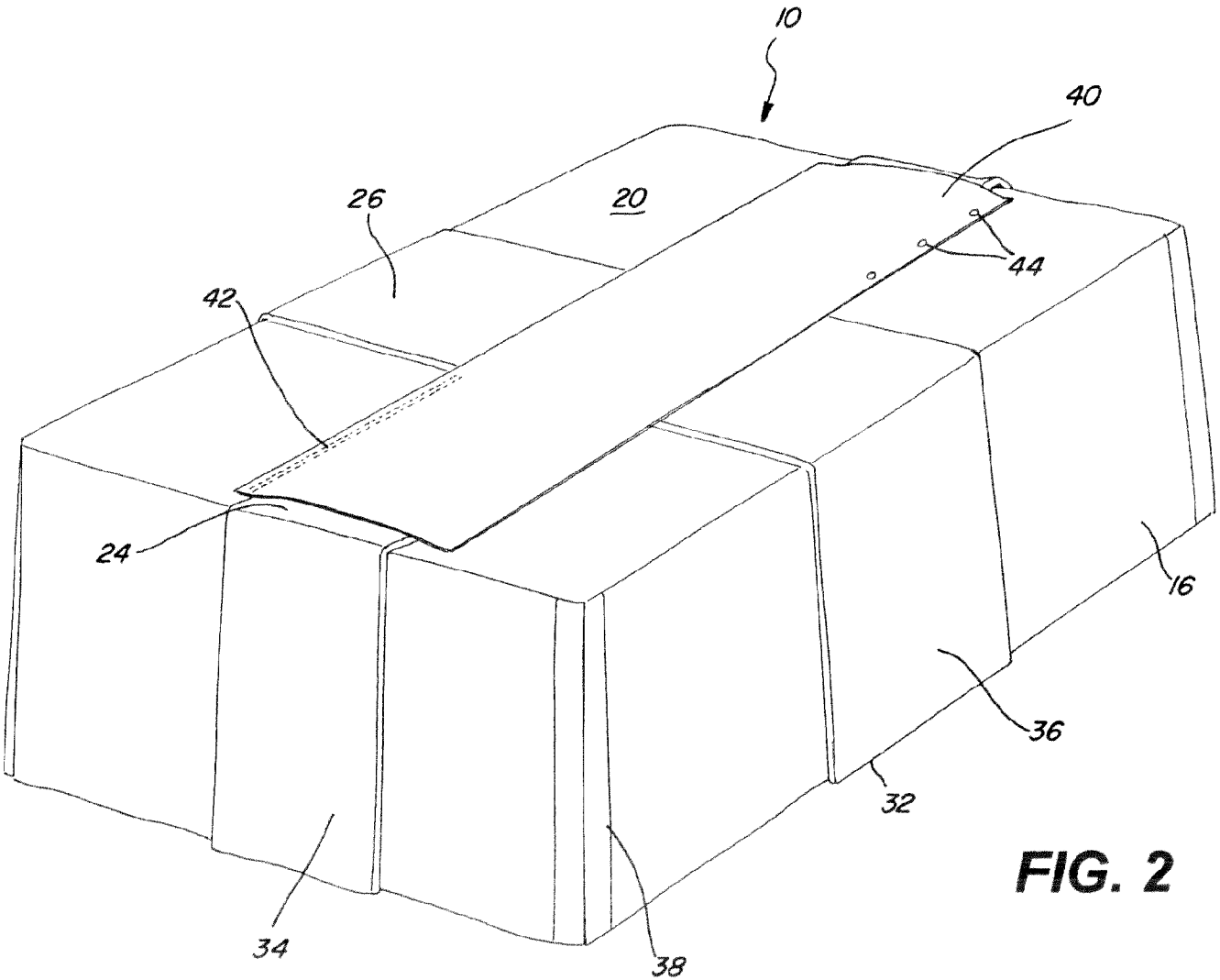
FIG. 2 is a bottom perspective view of the adjustable bed skirt in the configuration of FIG. 1.

FIGS. 1 and 2 show perspective top and bottom views, respectively, of an exemplary adjustable bed skirt 10 in accordance with this disclosure, wherein the bed skirt is configured for use with a crib-sized bed (not shown). The adjustable bed skirt 10, of a first length L1 and a first width W1, comprises a flat, rectangular supporting sheet or deck 14 and a peripheral ruffle 16 attached around the perimeter of the deck 14. The supporting sheet or deck 14 may be constructed of any durable and washable material, for example, e.g., woven fabric like duck cloth, cotton, hemp, or any other suitable materials. The supporting sheet or deck 14 comprises an upper surface 18, a lower surface 20, and a peripheral edge 22. The deck 14 is formed with at least a first longitudinal fold 24 and at least a first lateral fold 26, which are reversibly securable by a first longitudinal closure member 28 and a lateral closure member 30, respectively. The closure members 28, 30 for securing the folds may include zippers, hook-and-loop fasteners, buttons, snaps or any other conventional fastening device. In the illustrated embodiment, the closure members 28, 30 are zippers.

Figure 8:
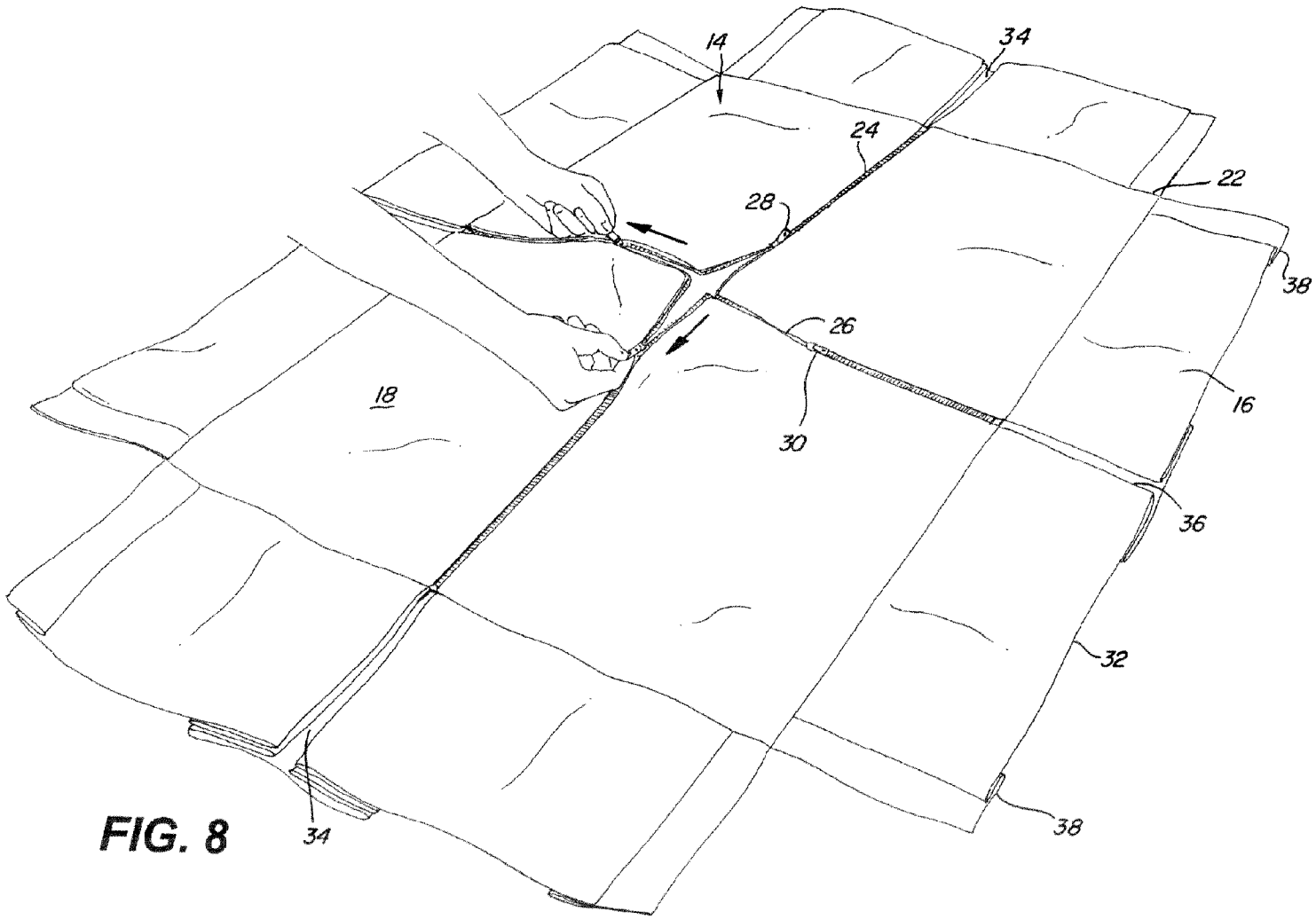
FIG. 8 shows a top view of the adjustable bed skirt in the configuration of FIG. 1, wherein the closure members securing the longitudinal and lateral folds are being unfastened to expand the adjustable bed skirt for use with a twin bed.

The ruffle 16 extends from the peripheral edge 22 of the deck 14 to a free edge 32. The ruffle 16 is either permanently or removably attached to the peripheral edge 22 of the deck 14. The ruffle 16 may be constructed of decorative fabric of any durable and washable material. As best shown in FIG. 8, the ruffle 16 includes an opposed pair of longitudinal releasable pleats 34 that extend from either end of the first longitudinal fold 24 to the free edge 32 of the ruffle 16, and an opposed pair of lateral releasable pleats 36, extending from either end of the first lateral fold 26 to the free edge 32 of the ruffle 16. The longitudinal and lateral releasable pleats 34 and 36 are configured such that the release of the first longitudinal fold 24 and the first lateral fold 26 expands the associated releasable pleats, as further discussed below. The ruffle 16 may also include a plurality of decorative box pleats 38.

The adjustable bed skirt 10 configured for use with a crib-sized bed shown in FIG. 1 is in an unexpanded or folded state, wherein all longitudinal folds, including the first longitudinal fold 24, and all lateral folds, including the first lateral fold 26, are in a closed or unreleased state. Even though only one longitudinal fold and one lateral fold are visible in the embodiment shown in FIG. 1, additional longitudinal folds and lateral folds may be hidden from view in the unexpanded state and will become visible in an expanded state, as further discussed below.

In a specific embodiment, as best shown in FIG. 1, the first longitudinal fold 24 and the first lateral fold 26 of the unexpanded deck 14 cross each other at the center of the deck 14. The first longitudinal fold 24 is releasably secured by the longitudinal closure members 28. Likewise, the first lateral fold 26 is releasably secured by the lateral closure members 30. Thus, an aspect of the present invention is understood to include a bed skirt having intersecting folds that are held in the folded state by releaseable securement members. In a particular embodiment, the intersecting folds include at least one longitudinal releaseable pleat and one lateral releaseable pleat and the releaseable securement members may include two or more zippers.

Figure 7A:
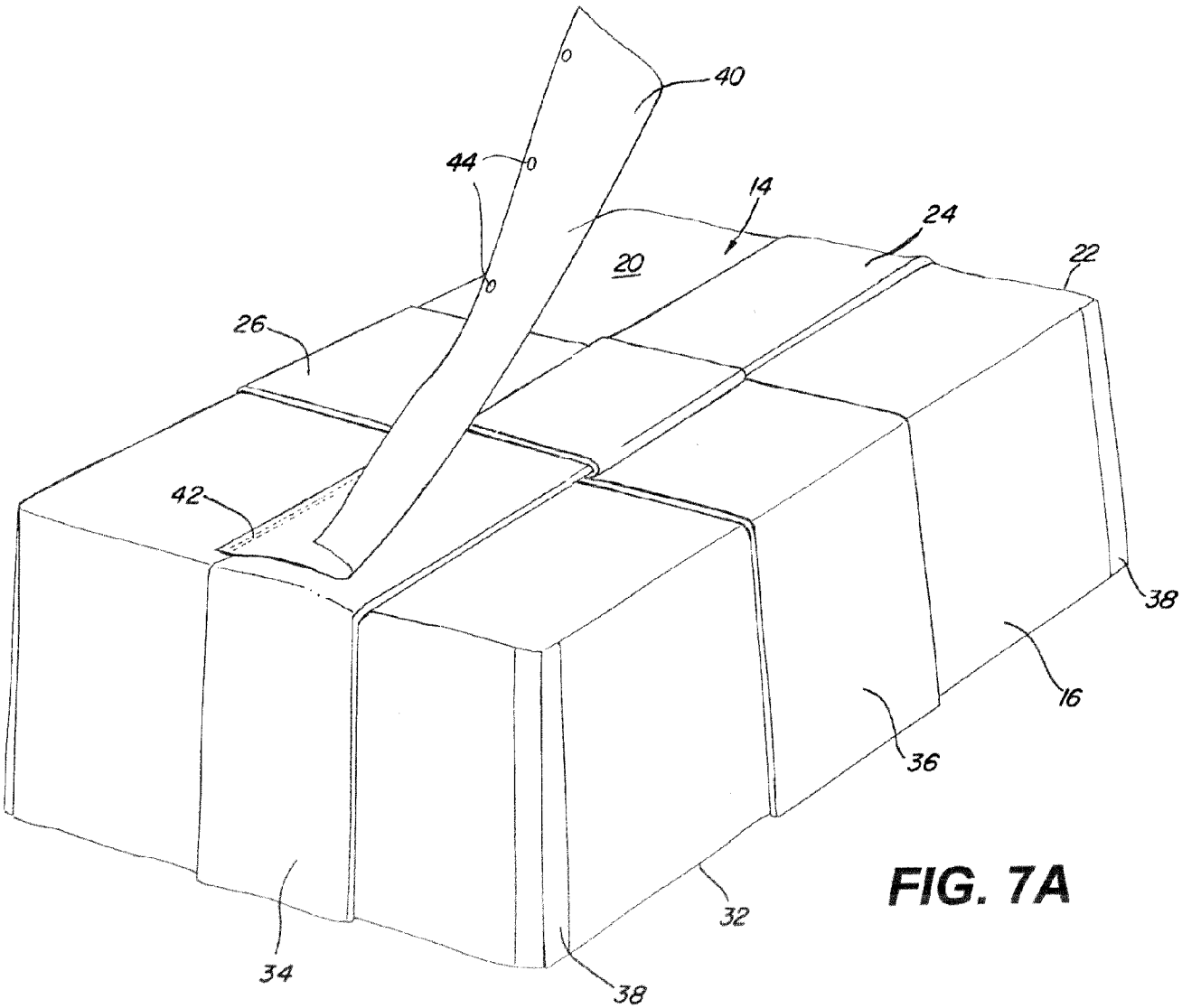
FIGS. 7A and 7B show bottom perspective views of the adjustable bed skirt in the configuration of FIG. 1, illustrating the removal of a fold retention sheet to permit the expansion of the adjustable bed skirt for use with a twin bed or a full bed.
Figure 7B:
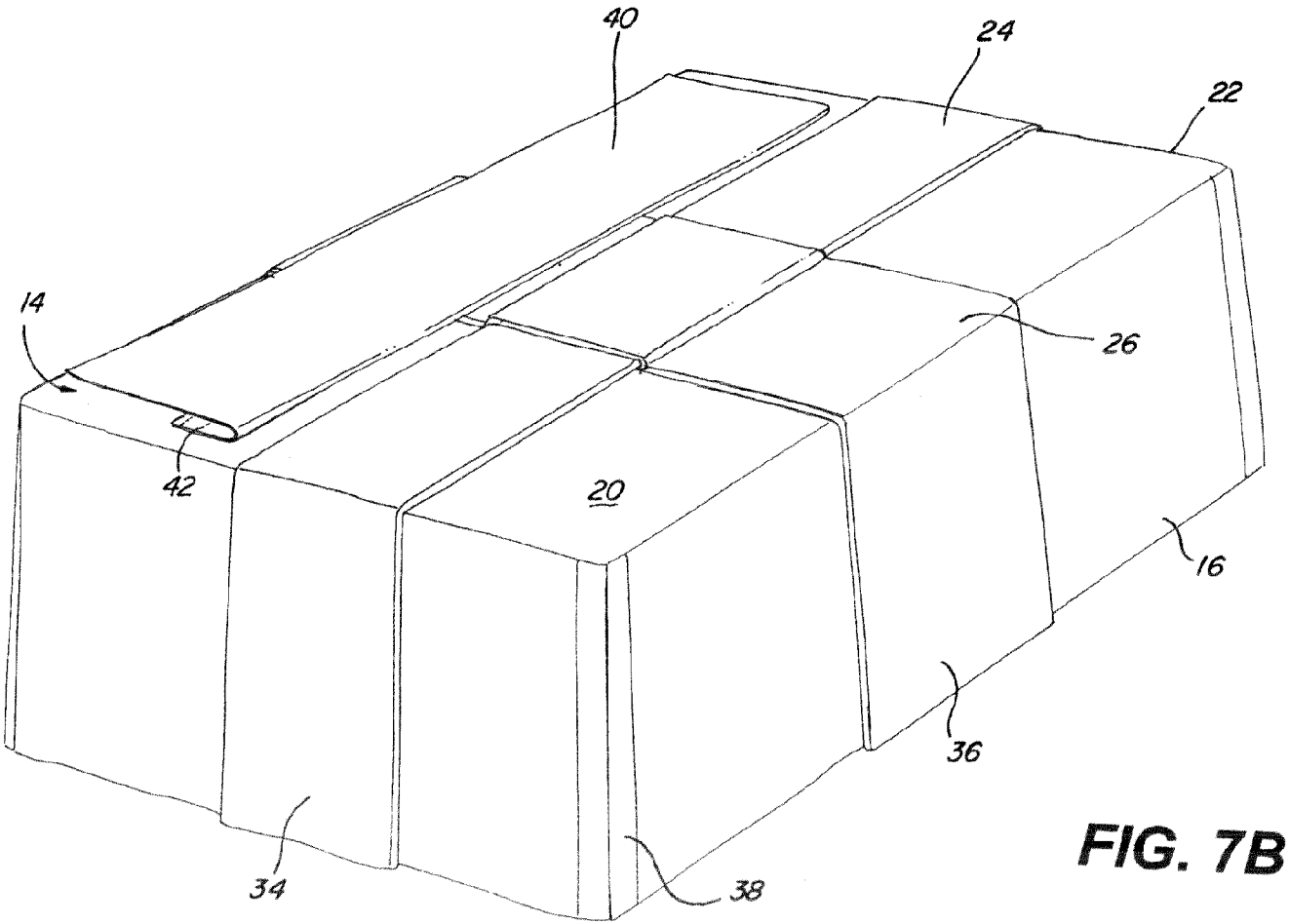

The first longitudinal and lateral folds 24 and 26 are best shown in FIGS. 2, 7A, and FIG. 7B, which show the underside of the first longitudinal fold 24 and the first lateral fold 26. The first longitudinal fold 24 extends into an opposed pair of the longitudinal releasable pleats 34 on the ruffle 16. Likewise, the first lateral fold 26 extends into an opposed pair of lateral releasable pleats 36 of the ruffle 16.

In one specific embodiment, as best shown in FIGS. 7A and 7B, the first lateral fold 26 underlies the first longitudinal fold 24. The relative positions of the longitudinal fold 24 and the lateral fold 26 reflect the order in which the folds are formed, as well as the order in which they are released. Specifically, in the embodiment illustrated in FIG. 2, the first lateral fold 26 is formed prior to the first longitudinal fold 24, as further discussed below. However, in use, the first longitudinal fold 24 is released prior the first lateral fold 26. In alternative examples, the longitudinal fold 24 is formed first and then the lateral fold 26 is formed.

A fold retention sheet 40, partially sewn to the lower surface 20 of the deck 14 at an edge 42, and partially attached to the lower deck surface 20 via a plurality of keeper elements 44, retains the first longitudinal fold 24 and the first lateral fold 26 in place. In a preferred embodiment, the keeper elements 44 may include hook-and-loop fasteners (e.g., VELCRO), buttons, snaps, or any other suitable fasteners.

FIGS. 7A, 7B, and 8 illustrate the steps of expanding the adjustable bed skirt 10 from a first size to a second size in accordance with the present disclosure. In one specific embodiment, to expand the bed skirt 10 from the crib-sized bed shown in FIGS. 1 and 2 to fit a larger bed, for instance a twin size bed (not shown), the first longitudinal fold 24 and first lateral fold 26 are released. As shown in FIG. 7A, first, the keeper elements 44 are unfastened, allowing the fold retention sheet 40 to be removed. However, the fold retention sheet 40 still remains attached to the lower deck surface 20 by the sewn edge 42 and thus can be reused when the adjustable bed skirt 10 is reduced from a larger size to the crib size. To keep the fold retention sheet 40 from being entangled with the subsequently released folds, as shown in FIG. 7B, the fold retention sheet 40 is folded along the sewn edge 42 on one side of the lower surface 20 of the deck 14. The adjustable bed skirt 10 is then turned over to the upper side 18.

Figure 3:
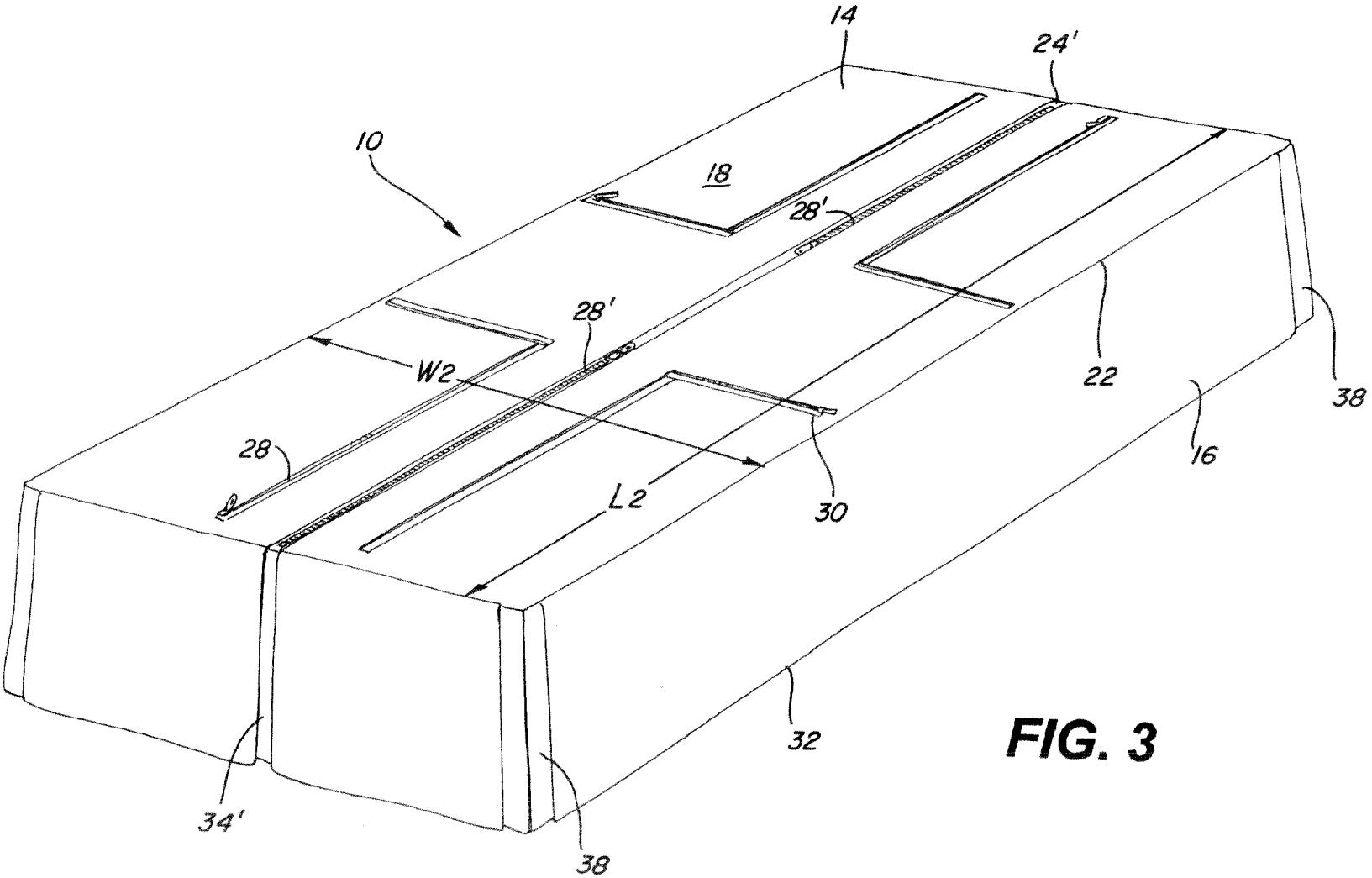
FIG. 3 is a top perspective view of the adjustable bed skirt of FIG. 1 expanded for use with a twin bed.

To release the first longitudinal fold 24 and first lateral fold 26, the closure members 28 and 30 are unfastened. FIG. 8 shows a top view of the adjustable bed skirt 10, fully spread out; wherein the closure members 28 and 30 securing the first longitudinal fold 24 and first lateral fold 26, respectively, are being unfastened. The release of the first longitudinal fold 24 opens up the opposed pair of longitudinal releasable pleats 34 on the ruffle 16. Likewise, the release of the first lateral fold 26 opens up the opposed pair of lateral releasable pleats 36. As a result, the adjustable bed skirt 10 is extended from the first, folded or unexpanded, length L1 to a second length L2 and the first, folded or unexpanded width, W1 to a second width W2, as shown in FIG. 3. Thus, features of the present invention are understood to include an adjustable bed skirt sized to fit over a first bed of a first dimension and having at least one lateral pleat and one longitudinal pleat to allow expanding the bed skirt to fit over a second bed of a second dimension, which is larger than the first dimension. For example, the first bed may have a dimension of a twin size bed and the second bed may have a dimension of a full size bed.

Figure 4:
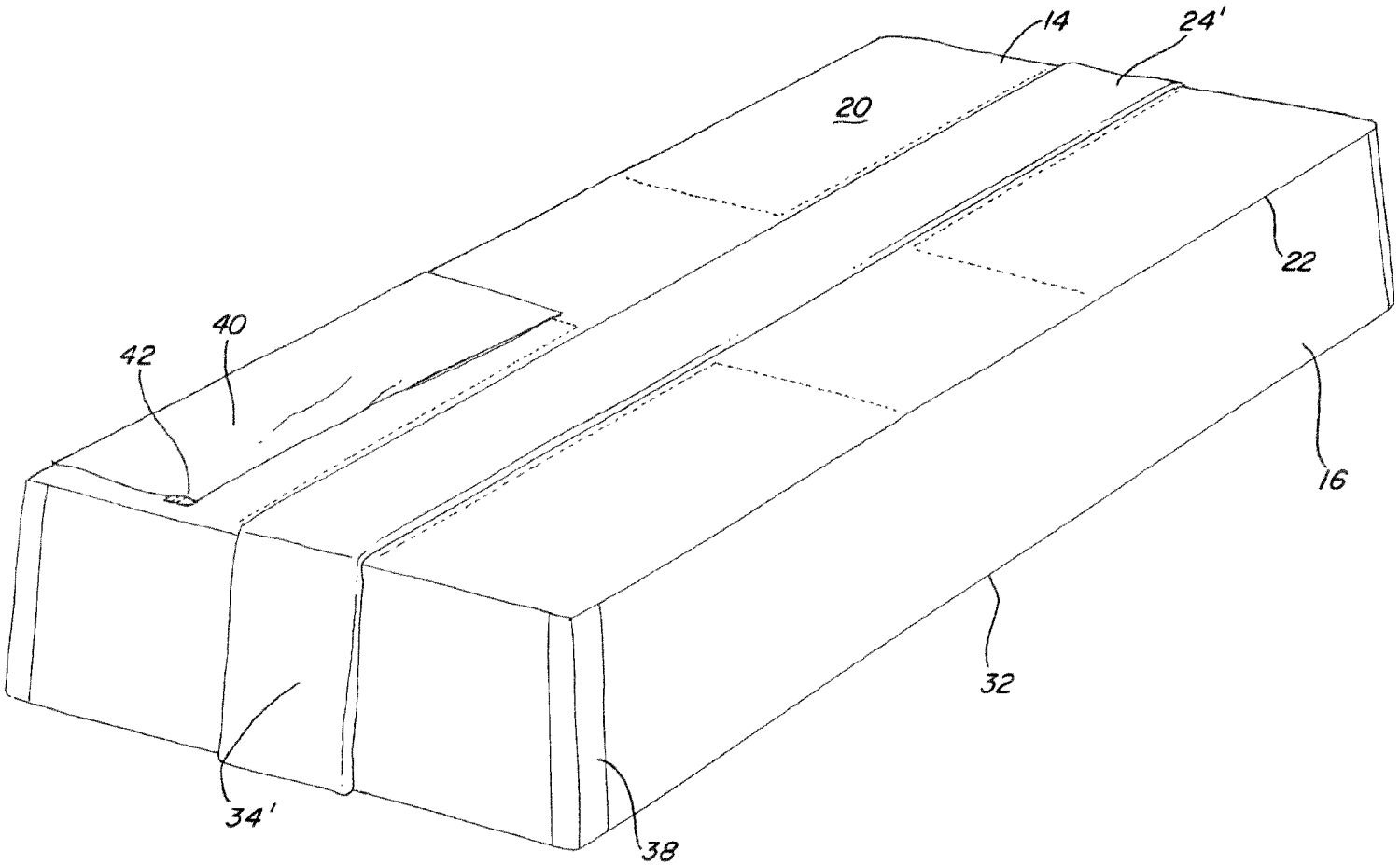
FIG. 4 is a bottom perspective view of the adjustable bed skirt in the configuration of FIG. 3.

FIGS. 3 and 4 show the top and bottom views, respectively, of the expanded bed skirt 10 sized for use with a twin-sized bed (not shown). In one embodiment, the expansion of the adjustable bed skirt from a first size to a second size reveals a second longitudinal fold 24' and no further lateral folds, as best shown in FIG. 3. The second longitudinal fold 24' allows the width of the bed skirt 10 to be further expanded. The absence of additional lateral folds indicates that the length of the adjustable bed skirt 10 is no longer extendible. In alternative embodiments, both additional longitudinal and lateral folds may be incorporated to further expand the width and the length of the adjustable bed skirt 10.

Figure 9:
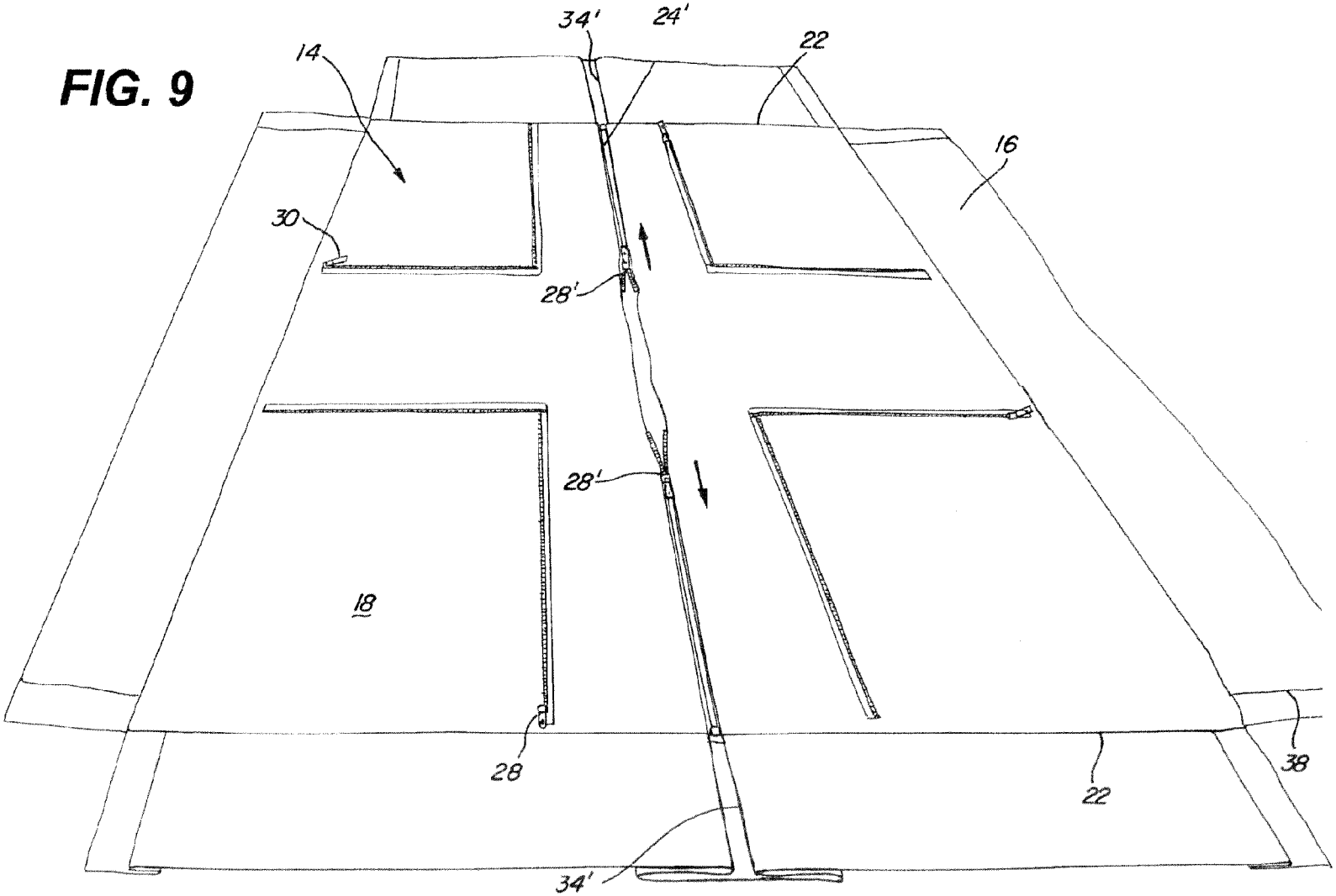
FIG. 9 shows a top view of the adjustable bed skirt in the configuration of FIG. 3, wherein the closure members securing additional longitudinal folds are being unfastened to further expand the adjustable bed skirt for use with a full bed.

In the embodiment illustrated in FIG. 3, second longitudinal closure members 28', which are spaced apart from each other, secure the second longitudinal fold 24'. In a preferred embodiment, the closure members 28' are zippers. The second longitudinal fold 24' is shown more clearly on the bottom view of the skirt, as illustrated in FIG. 4. The second longitudinal fold 24' coincides with an opposed pair of a second longitudinal releasable pleat 34' extending from either end of the second longitudinal fold 24' to the free edge 32 of the ruffle 16 (FIGS. 3 and 9).

Figure 5:
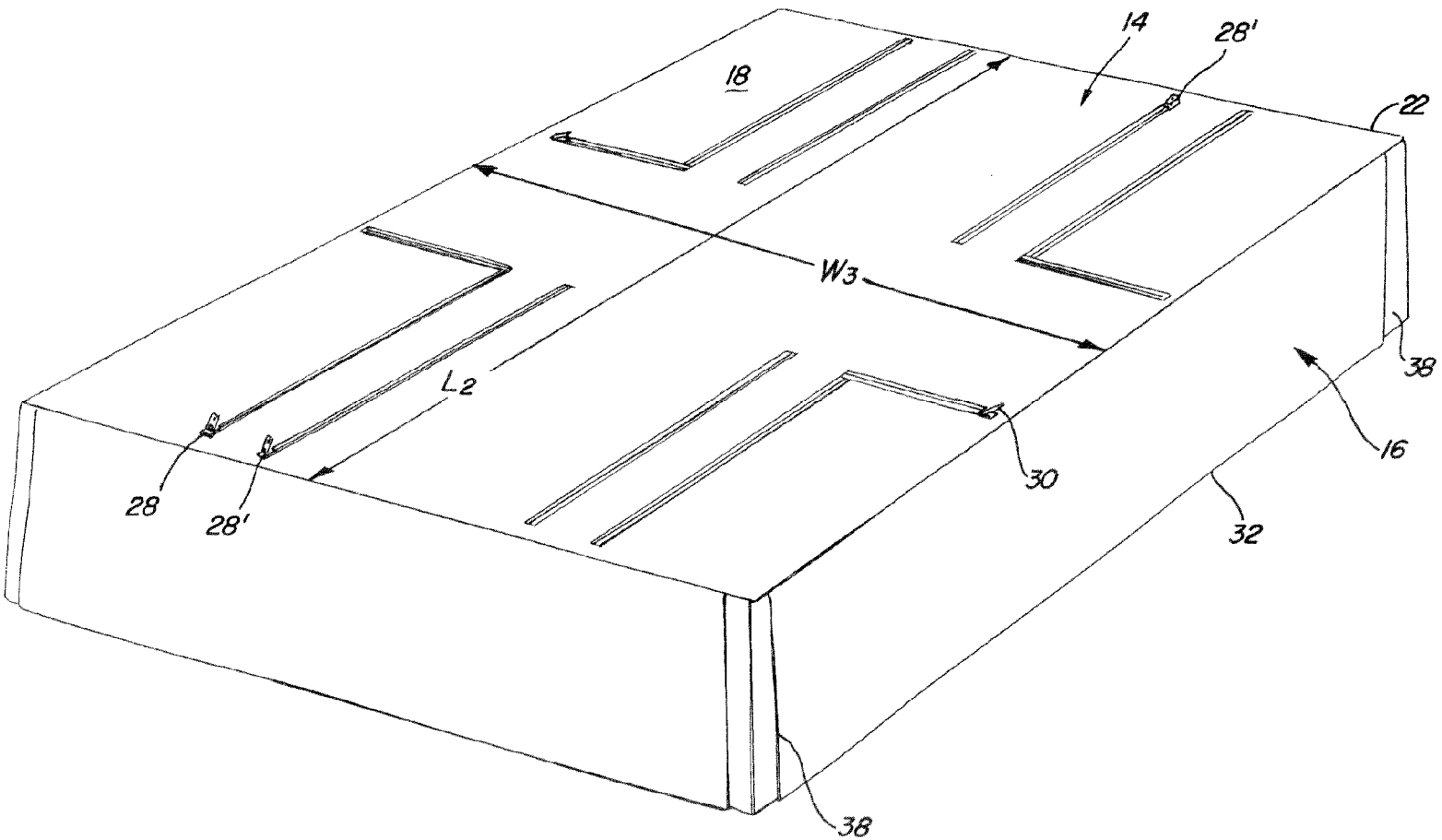
FIG. 5 is a top perspective view of the adjustable bed skirt of FIG. 3 further expanded for use with a full bed.

According to the illustrated embodiment, the adjustable bed skirt 10 expanded from a first size to a second size may be further extended to a third size. FIG. 9 shows a top view of the adjustable bed skirt 10, fully spread out, with the second longitudinal closure members 28' securing the second longitudinal fold 24' being unfastened. In the illustrated embodiment, to further extend the twin size bed skirt shown in FIG. 3 to a larger size, such as a full sized bed (not shown), the second closure members 28' are completely unfastened from the center of the deck 14 towards the peripheral edge 22 to release the second longitudinal fold 24'. The release of the second longitudinal fold 24' expands the second longitudinal releasable pleat 34' (FIGS. 4 and 9). As a result, the width of the bed skirt 10 expands from the second width W2 to a third width W3, while having the same length L2 (FIG. 5). It is to be understood that the adjustable bed skirt provided in accordance of aspects of the present invention may also be extended from the second length L2 to a third length L3 if desired.

Figure 6:
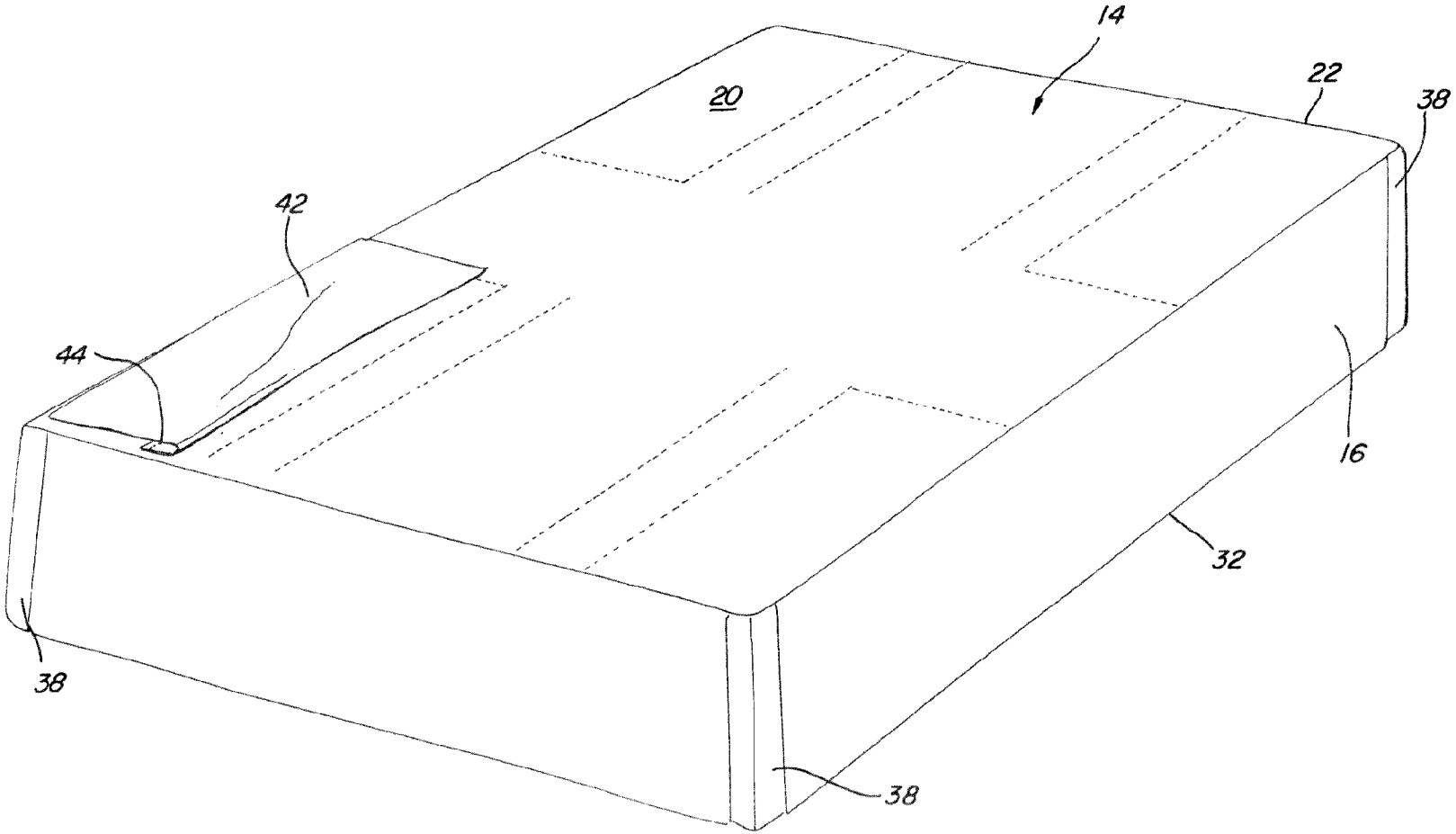
FIG. 6 is a bottom perspective view of the adjustable bed skirt in the configuration of FIG. 5.

FIGS. 5 and 6 show perspective top and bottom views, respectively, of the adjustable bed skirt 10 expanded for use with a full bed (not shown). In the illustrated embodiment, the adjustable bed skirt 10 is fully expanded and thus no longer has any longitudinal or lateral folds. FIG. 5 shows the unfastened closure members 28, 30 and 28'. Consistently, the lower surface 20 (FIG. 6) of the deck 14 no longer has any longitudinal or lateral folds. Likewise, the ruffle 16 no longer comprises any longitudinal or lateral releasable pleats. In other embodiments, the adjustable bed skirt 10 may contain additional longitudinal and lateral folds and their associated releasable pleats, which would allow the bed skirt 10 to be further adjustable, as desired, for example, to fit a queen-sized bed, a king-sized bed, or a bed of longer than standard length. In another example, the bed skirt has un-even numbers of lateral and longitudinal folds. For example, the bed skirt may have a single longitudinal fold adapted to expand the skirt one bed size. However, there may be two or more lateral folds to permit lengthening of the bed skirt two sizes longer, such as to fit a longer than standard length bed. Similarly, there may be more longitudinal folds than lateral folds.

It is to be understood that the process of enlarging or reducing the size of the adjustable bed skirt provided in accordance with this disclosure is fully reversible. Indeed, the dimensions of the bed skirt may be adjustable as desired by reversing the enlargement or reduction process described above.

During construction, according to one aspect of the present disclosure, the adjustable bed skirt 10 is configured to fit a larger sized bed, such as a king, queen or full bed, of an initial length $L_i$ and an initial width $W_i$. The deck 14 is constructed separately from the peripheral ruffle 16. The ruffle 16 is subsequently attached to the deck 14 as described above. To make the bed skirt 10 adjustable in size, as described above, the deck 14 is folded to create the required longitudinal folds 24 and lateral folds 26 which reduce the deck 14 from the initial width $W_i$, to a final width $W_f$, and from the initial length $L_i$ to a final length $L_f$, respectively. Each of the longitudinal folds 24 coincides with an opposed pair of longitudinal releasable pleats 34. Likewise, each of the lateral folds 26 extends into an opposed pair of the lateral releasable pleats 36. The longitudinal folds 24 and lateral folds 26 are reversibly secured with longitudinal and lateral closure members 28 and 30, as described above.

In a specific embodiment, the adjustable bed skirt 10 is initially sized and configured for use with a full bed, having the length L2 and the width W3 (FIG. 5). To make the full bed skirt adaptable for use with a twin bed, which has the same length L2 but a narrower width W2, the deck 14 is folded into the second longitudinal fold 24' (FIGS. 3 and 4) and fastened with a pair of second longitudinal closure members 28'. The second longitudinal fold 24' extends into an opposed pair of the second longitudinal releasable pleats 34' on the ruffle 16 (FIGS. 3 and 4).

To make the adjustable bed skirt 10 further reducible to a still-smaller (e.g., crib size), additional longitudinal and lateral folds and their corresponding pleats and pleats are created. In a specific embodiment, the adjustable bed skirt 10 initially configured for a full bed, adjusted for use with a twin bed, is further reducible for use with a crib having the length L1 and the width W1 (FIG. 1). Accordingly, the deck 14 is folded into the first lateral fold 26, fastened with a pair of lateral closure members 30. The first lateral fold 26 extends into an opposed pair of the corresponding lateral releasable pleats 36 on the ruffle 16 (FIGS. 2 and 8). Subsequently, the deck 14 is folded into the first longitudinal fold 24, and fastened with a pair of longitudinal closure members 28. Likewise, the first longitudinal fold 24 extends into an opposed pair of the longitudinal releasable pleats 34. The fold retention sheet 40, partially sewn onto the lower deck surface 20 at the edge 42 (FIG. 7A), secures the undersides of the first longitudinal and lateral folds 24 and 26 with the plurality of keeper elements 44 (FIGS. 2 and 7A).

It is to be understood that the adjustable bed skirt provided in accordance with the present invention may be configured to be adaptable to any bed sizes by introducing appropriate folds and pleats. The number of folds and pleats to be incorporated in the adjustable bed skirt 10 depends on several factors. Non-limiting examples include the difference in size between the original size and targeted size, allowable thickness of the folds to make them comfortable, esthetically appealing and reversibly securable, allowable number of layers of the reversible and releasable pleats to keep them esthetically appealing and securable.

Many alterations and modifications may be made by those having ordinary skill in the art, without departing from the spirit and scope of the disclosure. Therefore, it must be understood that the illustrated embodiments have been set forth only for the purposes of examples, and that the embodiments should not be taken as limiting the scope of the following claims. The following claims are, therefore, to be read to include not only the combination of elements which are literally set forth, but all equivalent elements for performing substantially the same function in substantially the same way to obtain substantially the same result. The claims are thus to be understood to include those that have been illustrated and described above, those that are conceptually equivalent, and those that incorporate the ideas of the disclosure.

What is claimed is:

1. An adjustable bed skirt, comprising:

a deck having a peripheral edge, a releasably securable longitudinal fold, and a releasable securable lateral fold forming a first deck area for fitting over a first bed size; and a ruffle extending from the peripheral edge of the deck and including a plurality of extendible pleats extending from the peripheral edge of the deck to a free edge;

wherein each of the longitudinal and lateral folds extends into an associated one of the pleats; and wherein the deck has a second deck area, which is larger than the first deck area for fitting over a second bed size, when the releaseably securable longitudinal fold and the releaseably securable lateral fold are expanded.

2. The adjustable bed skirt of claim 1, further comprising a plurality of closure members arranged on the longitudinal fold and lateral fold so as to reversibly secure the longitudinal fold and lateral fold.

3. The adjustable bed skirt of claim 2, wherein the closure members include zippers.

4. The adjustable bed skirt of claim 1, further comprising a fold retention sheet removably securing the releasable securable longitudinal fold and the releasable securable lateral fold to a lower surface of the deck.

5. A method for making an adjustable bed skirt, comprising:

(a) providing a deck having a first length, a first width, and peripheral edge;

(b) providing a ruffle comprising first and second peripheral edges;

(c) attaching the ruffle around the perimeter of the deck at the peripheral edge of the deck;

(d) folding the deck to create a longitudinal fold and a lateral fold;

(e) releasably securing the longitudinal fold and the lateral fold to change the width of the deck to a second width less than the first width and a second length less than the first length;

(f) forming a plurality of releasable pleats in the ruffle, the pleats being located so that each of the lateral folds and each of the longitudinal folds coincides with an opposed pair of the pleats; and (g) releasably securing the pleats that coincide with the lateral fold and the longitudinal fold.

6. The method of claim 5, wherein the releasably securing the longitudinal and lateral fold is by means of closure members.

7. The method of claim 6, wherein the closure members include zippers.

8. The method of claim 5, the method further comprises removably securing the longitudinal fold and lateral fold to a lower surface of the deck with a fold retention sheet.

9. The method of claim 8, wherein the method further comprises releasably securing the fold retention sheet with keeper elements.

10. The method of claim 9, wherein the keeper elements include hook and loop fasteners.

11. A method for using an adjustable bed skirt, wherein the bed skirt comprises a deck releasably folded into a lateral fold and a longitudinally fold so as to have a length and a width and a peripheral edge; and a ruffle attached around the perimeter of the deck at the peripheral edge of the deck, the ruffle having a plurality of releasably extendible pleats aligned with the lateral fold and the longitudinal fold, the method comprising:

(a) releasing the pleats;

(b) releasing the lateral fold and unfolding the deck along the lateral fold to increase the length of the deck; and (c) releasing the longitudinal fold and unfolding the deck along the longitudinal fold to increase the width of the deck.

12. The method of claim 11, the method further comprises removing a fold retention sheet removably securing the longitudinal fold and lateral fold on a lower surface of the deck prior to releasing the pleats.

13. The method of claim 11, wherein the releasing the lateral fold is by removing lateral closure members releasably securing the lateral fold.

14. The method of claim 11, wherein the releasing the longitudinal fold is by removing longitudinal closure members releasably securing the longitudinal fold.

15. The method of claim 13, wherein the lateral closure members include zippers.

16. The method of claim 14, wherein the longitudinal closure members include zippers.

* * * * *